US006733562B2

(12) United States Patent
Knünz et al.

(10) Patent No.: US 6,733,562 B2
(45) Date of Patent: May 11, 2004

(54) METHOD OF PRODUCING HARD METAL GRADE POWDER

(75) Inventors: Gerhard Knünz, Lechaschau/Tirol (AT); Helmut Beirer, Pflach/Tirol (AT); Andreas Lackner, Reutte/Tirol (AT); Wolfgang Glätzle, Reutte/Tirol (AT); Erwin Hartlmayr, Breitenwang/Tirol (AT)

(73) Assignee: Ceratizit Austria GmbH, Reutte/Tirol (AT)

( * ) Notice: Subject to any disclaimer, the term of this patent is extended or adjusted under 35 U.S.C. 154(b) by 0 days.

(21) Appl. No.: 10/302,216

(22) Filed: Nov. 22, 2002

(65) Prior Publication Data

US 2003/0075012 A1 Apr. 24, 2003

Related U.S. Application Data

(63) Continuation of application No. PCT/AT02/00075, filed on Mar. 8, 2002.

(30) Foreign Application Priority Data

Mar. 29, 2001 (AT) ..... 230/2001 U

(51) Int. Cl.[7] ..... B22F 1/00; B22F 3/00

(52) U.S. Cl. ..... 75/351; 75/230; 419/10; 419/36; 419/40

(58) Field of Search ..... 75/230, 236, 242, 75/252, 351; 419/10, 36, 40

(56) References Cited

U.S. PATENT DOCUMENTS

| | | | | | |
|---|---|---|---|---|---|
| 4,070,184 | A | * | 1/1978 | Scheithauer et al. | 419/18 |
| 4,397,889 | A | | 8/1983 | Benjamin et al. | 427/221 |
| 4,456,484 | A | * | 6/1984 | Benjamin et al. | 75/252 |
| 4,478,888 | A | * | 10/1984 | Benjamin et al. | 427/220 |
| 4,902,471 | A | | 2/1990 | Penkunas et al. | 419/33 |
| 5,007,957 | A | | 4/1991 | Penkunas et al. | 75/252 |
| 5,045,277 | A | | 9/1991 | Penkunas et al. | 419/15 |
| 5,922,978 | A | | 7/1999 | Carroll | 75/240 |

FOREIGN PATENT DOCUMENTS

DE 281 359 A5 8/1990

* cited by examiner

*Primary Examiner*—Ngoclan T. Mai
(74) *Attorney, Agent, or Firm*—Laurence A. Greenberg; Werner H. Stemer; Gregory L. Mayback

(57) ABSTRACT

A hard metal grade powder is produced from hard material, metal binder, and non-water-soluble pressing aid components, by forming a slurry containing the components and pure water as a liquid phase and then drying the slurry. Here, the hard material and metal binder components are first milled in water, to form a slurry. Then the pressing aid components are added to the slurry in the form of an emulsion produced with the aid of an emulsifier with the addition of water.

11 Claims, 3 Drawing Sheets

METHOD OF PRODUCING HARD METAL GRADE POWDER

CROSS-REFERENCE TO RELATED APPLICATION

This application is a continuation of copending International Application No. PCT/AT02/00075, filed Mar. 8, 2002, which designated the United States and which was not published in English.

BACKGROUND OF THE INVENTION

Field of the Invention

The invention lies in the metallurgy processing field. More specifically, the invention relates to a method of producing a hard metal refractory hard metal grade powder consisting of hard material, binding metal and non-water-soluble pressing aid components by drying a slurry containing the components using pure water as a liquid phase.

Molded parts made of hard metal alloys are produced by pressing and sintering powdered base materials. This is accomplished by milling the hard material and binding metal components in a liquid medium to a form a finely dispersed mixture which takes the form of a slurry. When coarser-grained starting powders are used, this step also involves milling the starting powders, whereas the slurry is merely homogenized when fine-grained starting powders are used. The liquid protects the powder particles against fusion and prevents them from oxidizing during the milling process.

Suitable milling systems used almost exclusively today are agitator ball mills known as attritors, in which the material to be milled is set in motion together with hard metal balls by a multiple-blade agitator arm inside a cylindrical container. A pressing aid, e.g. paraffin, can be introduced to the slurry produced through the liquid-enhanced milling process. The addition of a pressing aid facilitates the compression of the hard metal grade powder during the pressing process and also enhances its green strength, which facilitates the handling of the pressed molded parts. The slurry is then dried to produce a finished hard metal grade powder that is ready for subsequent processing involving pressing and sintering.

A commonly used drying method is spray drying. In this process, slurry with a sprayable consistency is sprayed through a nozzle positioned inside the spray tower. A stream of hot gas dries the airborne spray droplets, which then precipitate as granulate in the form of small granules or beads in the lower conical segment of the spray tower, from where it can then be removed. The great advantage of producing a hard metal grade powder in granular form is that the flow characteristics of the hard metal grade powder are substantially improved, which facilitates the process of filling in compacting dies.

Spray towers in spray drying systems used in the hard metal industry are designed with a cylindrical upper segment and a conical, downward pointing lower segment and ordinarily operate in a countercurrent mode in accordance with the fountain principle, i.e. the sprayer lance is positioned in the center of the lower segment of the spray tower and sprays the slurry under high pressure (12–24 bar) upward in the form of a fountain. The gas stream which dries the sprayed droplets flows into the drying chamber from above, against the direction of travel of the sprayed droplets, and escapes from the spray tower in the upper third portion of the conical, downward pointing segment below the spray lance. In this way, the droplets are first conveyed upward and then pulled downward by the force of gravity and the opposing stream of gas. In the course of the drying cycle, the droplets are transformed into a compact granulate with a low residual moisture content. As they fall to the floor of the spray tower, they automatically trickle down through the conical, downward pointing lower segment to the central discharge outlet.

Because the flight pattern of the sprayed droplets takes them first upward and then down, the distance traveled by the droplets during drying is equivalent to that of spray towers that operate with co-current downward streams of sprayed slurry and drying gas, but the process requires almost fifty percent less tower height.

Spray towers in practical use which operate with countercurrents on the basis of the fountain principle have a cylindrical segment measuring between 2 and 9 m in height with a height-diameter ratio of between 0.9 and 1.7, whereas spray towers which operate in a co-current mode with top-down gas and sludge flow are equipped with a cylindrical segment measuring between 5 and 25 m in height with height-diameter ratio ranging from 1:1 to 5:1.

In the hard metal industry, such organic solvents as acetone, alcohol, hexane or heptane are still used almost exclusively in the milling and pressing of slurries today. These solvents are used in concentrated form or diluted only slightly with water. As the wax-based pressing aids, such as paraffin, frequently used in practical applications are generally readily soluble in these solvents, no problems arise in the milling and spraying of the hard metal grade powder.

The great disadvantage is that all of these solvents are highly flammable and volatile. Therefore, attritors and spray drying systems must be designed as explosion-resistant units, which requires considerable engineering design input and thus generates high costs. In addition, the materials must be dried in an inert gas atmosphere, ordinarily nitrogen, in the spray tower.

All of the above-mentioned solvents are also environmental pollutants and are subject to substantial evaporation loss, despite the use of recycling measures, due to their high volatility.

In view of the significant disadvantages involved in the use of these organic solvents, attempts have been made to replace the organic solvents with water. The difficulty involved is that the most commonly used pressing aids—such as paraffin, for example—are not water-soluble, which means that special measures must be taken in producing the slurry in order to ensure satisfactory quality of the finished hard metal grade powder.

The general term "hard metal" as used in this specification also encompasses so-called cermets, a special group of hard metals which ordinarily contain hard materials with nitrogen. U.S. Pat. No. 4,397,889 describes a method of producing a hard metal grade powder in which a pressing aid that is not soluble in the liquid milling medium is used. As examples, the patent mentions paraffin as a pressing aid and water as a milling medium. To achieve a suitable hard metal grade powder with uniform distribution of the pressing aid despite the insolubility of the pressing aid in the milling medium, the patent specification proposes heating the hard material powder components first, with or without metal binder particles, to a temperature above the melting point of the pressing aid and then mixing them with the pressing aid. The powder mixture is then cooled as rapidly as possible in order to limit oxidation of the powder. In order to prevent excessive lump formation of the powder mixture during cooling, the mixture is kneaded during the cooling phase. After cooling, metal binder components are added, if not already contained in the powder mixture, and the powder mixture is milled in water. The slurry produced in this manner is then sprayed and dried, e.g. in a spray drying system. A disadvantage of this process is that the mixing units in which the hard metal powder and the pressing aid are mixed are heavily soiled by lumpy, adhesive deposits of the powder-pressing-aid mixture and must be cleaned to remove all residues at considerable effort and cost before each new hard metal powder production run.

SUMMARY OF THE INVENTION

It is accordingly an object of the invention to provide a method of producing a hard metal grade powder which overcomes the above-mentioned disadvantages of the heretofore-known devices and methods of this general type.

With the foregoing and other objects in view there is provided, in accordance with the invention, a method of producing a refractory hard metal grade powder of hard material, metal binder, and non-water-soluble pressing aid components, the method which comprises:

milling the hard material and the metal binder with water as a liquid phase to prepare a slurry;

subsequently mixing the pressing aid components in the form of an emulsion produced with an emulsifier and an addition of water with the slurry; and drying the slurry with the hard material, the metal binder, and the pressing aid components to form a hard metal grade powder.

In other words, the objects are achieved in the preferred embodiment of the invention relating to the production of a hard metal grade powder in that the hard material and metal binder components are first milled in water, forming a slurry, and in that the pressing aid components are added to the slurry after milling in the form of an emulsion produced with the aid of an emulsifier with the addition of water.

This procedure provides a simple way of achieving uniform distribution of the pressing aid in the hard metal grade powder. The emulsion can be produced without difficulty in a standard commercially available emulsification system equipped with a double-walled vat with an agitator and a high-dispersion unit. After the pressing aid and the emulsifier are melted, the desired quantity of water is added. When the temperatures of the two incompatible phases (pressing aid and water) are equivalent, and not before, the pressing aid phase is dispersed in the water with the aid of a very high-speed (e.g. about 6,000 rpm) high-dispersion unit. As a rule, standard commercially available emulsifiers such as those used in the food processing industry may be used. The emulsifier must be matched to the specific composition of the pressing aid that is to be emulsified. In selecting an emulsifier, it is important to ensure that it contains no substances that would negatively affect subsequent steps in the hard metal production process, such as alkaline, alkaline-earth or sulphur compounds which may form crack-causing phases after sintering. In addition, it should be ensured that the emulsifier contains no emulsion-stabilizer additives, e.g. agents which raise the pH level, as these additives may not evaporate completely during wax separation and could cause problems during subsequent sintering of the hard metal powder. Even without such stabilizing additives, the emulsion remains stable at room temperature for at least 5 days, allowing sufficient time for trouble-free production of the hard metal powder.

Particularly advantageous is the use of an emulsifier suitable for the production of an emulsion with a mean droplet diameter of less than 1.5 $\mu$m.

Paraffin is commonly used as a pressing aid in the production of hard metal powders.

When paraffin is used, a mixture of fatty alcohol polyglycol ether and monodiglycerides has proven effective as an emulsifier in emulsion production.

Particularly advantageous in the production of hard metal grade powder in accordance with the invention is the milling of the powder in an attritor with a slurry viscosity ranging between 2,500 and 8,000 mPa·s (measured in an RC 20 rheometer manufactured by Europhysics at a shear rate of 5.2 [1/s]) and a minimum four-fold to eight-fold volume exchange per hour.

In this way, it is possible to achieve such short milling times even in the production of slurry containing hard material and binding metal components with particle sizes significantly below 1 $\mu$m that excessive particle oxidation is avoided.

Particularly interesting is the application of the process embodying the invention for the production of a hard metal grade powder to dry the slurry in a spray drying system to produce a hard metal granulate. In the preferred embodiment of the invention, a spray tower comprising a cylindrical segment and a conical segment is used in which the gas stream which dries the slurry enters the drying chamber at a temperature of between 130° and 195° C. and exits the system at a temperature within the range of 85°–117° C., whereby the spray tower is designed and operated in such a way that the ratio of the quantity of water added via the slurry (in liters per hour) to tower volume (in $m^3$) is between 0.5 and 1.8 and in that a maximum of 0.17 kg of slurry is atomized per $m^3$ of incoming drying gas, whereby the slurry has a solid particle concentration within a range of 65–85% by weight.

It will be understood that the available energy generated by the volume and temperature of the incoming gas stream must be sufficient to vaporize the added quantity of water without difficulty.

The important characteristic of this special spray drying process is that the quantity of water added via the slurry must be must smaller in proportion to tower volume than is ordinarily the case in spray towers and that the air quantity must be adjusted to the sprayed slurry so as to ensure that at least 1 $m^3$ of air is available per 0.17 kg of slurry. In this way, the process achieves under currently prevailing conditions both non-destructive drying and a maximum residual moisture concentration of 0.3% by weight in proportion to the finished granules.

Oxidation of even extremely fine-grained starting powders is largely avoided under the process conditions described above.

It will be further understood by those skilled in the pertinent art that in this process, as is generally the case in the production of hard metal granulates, the carbon balance must be adjusted on the basis of the chemical analysis of the starting powder used and oxygen intake during milling and spray drying, if necessary by adding carbon prior to milling, so as to ensure that a finished sintered hard metal can be produced with the hard metal granulate without an eta phase and without free carbon.

As a rule, the mean particle size of the granulate produced lies between 90 and 250 $\mu$m and can be adjusted by changing the size of the spray nozzle opening, the viscosity of the sprayed slurry and/or the spraying pressure. Smaller nozzle openings, lower viscosities and higher spraying pressures lower the mean particle size. The quantity of slurry introduced through the spray nozzle is regulated by adjusting the spraying pressure or the size of the swirl chamber and/or the spray nozzle opening.

Although the special spray drying process can be used in both co-current and countercurrent spray drying systems, it has proven most effective in countercurrent spray drying systems that operate according to the fountain principle, which favors a more compact construction of the spray drying system.

It has also proven advantageous to construct the upper cylindrical segment of the spray tower with a height of approximately 6 m and a diameter of between 4 and 5 m. A conical angle of about 45°–50° in the lower conical segment has also proven favorable.

A particular advantage of the drying process embodying the invention is that it permits the use of air as a drying gas, which makes the process extremely cost-effective.

If spray drying is carried out using a countercurrent spray drying system based on the fountain principle, it is advantageous to adjust the temperature of the inflowing drying air at the upper end of the cylindrical segment and the temperature of the drying air at the point at which it leaves the conical lower segment of the spray tower within the specified ranges in such a way as to set a temperature between 70° and 120° C. at the geometric midpoint (S) of the spray tower. Under these conditions, oxidation of the hard metal granulate is reduced to a minimum.

Other features which are considered as characteristic for the invention are set forth in the appended claims.

Although the invention is illustrated and described herein as embodied in a method of producing hard metal grade powder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
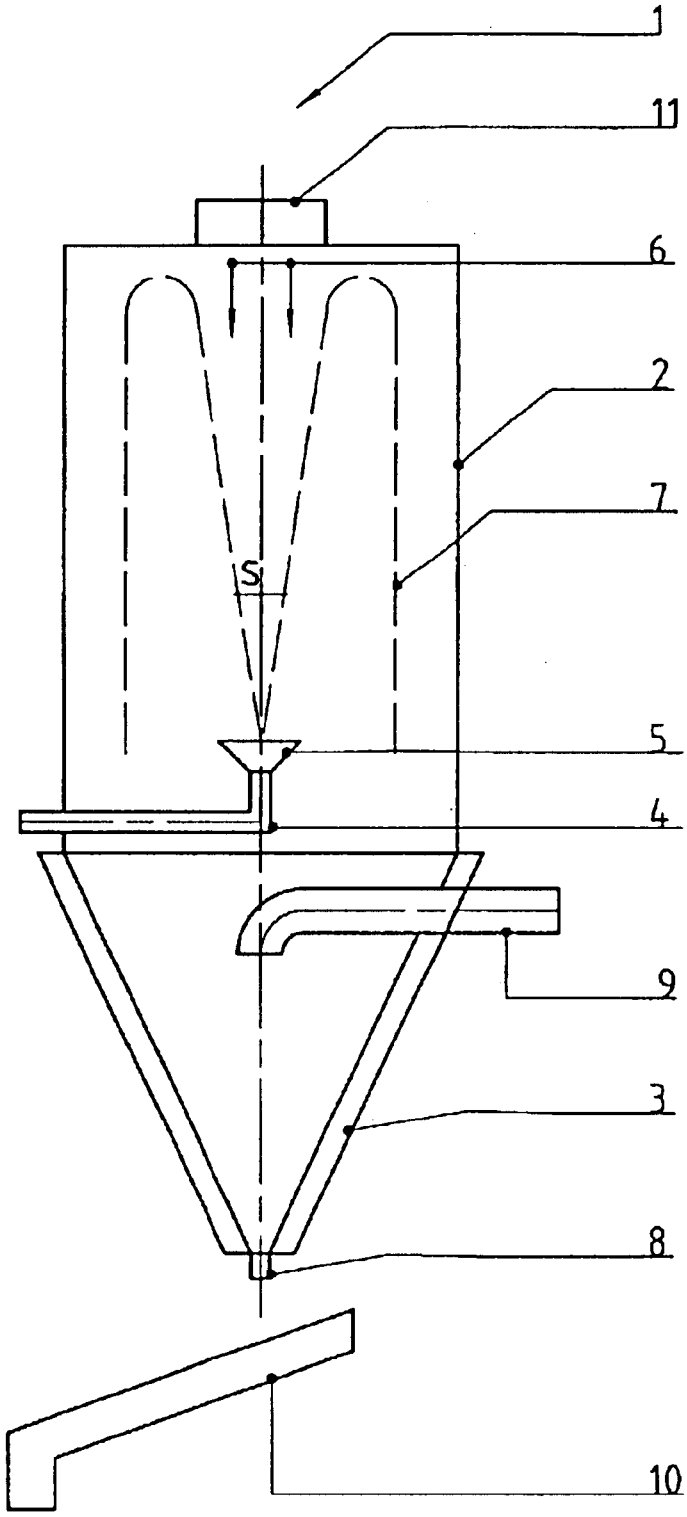
FIG. 1 is a schematic diagram illustrating the basic principle of a spray tower which offers a particularly advantageous solution for the production of hard metal granulate from a slurry produced in accordance with the invention.

Referring now to the figures of the drawing in detail and first, particularly, to FIG. 1 thereof, the exemplary spray tower 1 consists of a cylindrical segment 2 and an attached lower, conical, downward pointing segment 3. The spray tower 1 operates in a counter-current mode in accordance with the fountain principle, i.e. the stream of gas which dries the granulate is introduced at the upper end 11 of the cylindrical segment and forced downward, while the atomized slurry is sprayed upward like a fountain against the direction of gas flow 6 through a spray lance 4 with a nozzle opening 5 from the lower end of the cylindrical segment.

Thus the sprayed liquid droplets 7 initially travel upward before reversing their course in response to the opposing gas current and the force of gravity and falling downward. Before coming to rest on the floor of the spray tower 1 in the conical, downward pointing segment 3, the liquid droplets 7 must be transformed into dry granulate.

The granulate is guided through the conical, downward pointing segment 3 of the spray tower to a discharge outlet 8. The gas stream 6 enters the cylindrical segment 2 at a temperature between 130° and 195° C. and escapes from the spray tower through the gas outlet pipe 9 below the spray lance 4 in the upper third portion of the conical segment 3 at a temperature between 85° and 117° C. Preferably, the gas entry and exit temperatures are adjusted in such a way as to achieve a temperature between 70° and 120° C. at a geometric midpoint S of the spray tower. It is important that the ratio of the quantity of water added via the slurry (in liters per hour) to tower volume (in $m^3$) is between 0.5:1 and 1.8:1 and in that a maximum of 0.17 kg of slurry is atomized per $m^3$ of incoming drying gas. The slurry should have a solid particle concentration within the range of 65–85% by weight. It must also be ensured, of course, that available energy introduced by the quantity and temperature of the incoming gas stream must be sufficient to vaporize the added quantity of water without difficulty.

It is advantageous to design the conical segment 3 of the spray tower as a double-wall construction to accommodate circulation of a coolant, e.g. water. This will ensure that the granulate is cooled in this segment of the spray tower to a temperature not exceeding 75° C.

After leaving the spray tower 1 through the discharge outlet 8, the granulate enters a cooling channel 10, where it is cooled to room temperature.

The invention will now be described in the following text with reference to a production example.

EXAMPLE

In order to produce a waxed hard metal granulate with a mean particle size of 125 μm consisting, apart from a wax (paraffin) content of 2%, of 6% cobalt by weight, 0.4% vanadium carbide by weight and the remainder tungsten carbide, 36 kg of powdered cobalt with a mean particle size of about 0.8 μm FSSS and an oxygen content of 0.56% by weight, 2.4 kg of powdered vanadium carbide with a mean particle size of about 1.2 μm FSSS and an oxygen content of 0.25% by weight and 561.6 kg of tungsten carbide powder with a BET surface area of 1.78 $m^2/g$, which corresponds to a mean particle size of about 0.6 μm, and an oxygen content of 0.28% by weight were milled with 148 liters of water in an attritor for 5 hours. The materials were milled with 2000 kg of hard metal balls measuring 9 mm in diameter at an attritor speed of 78 rpm. Pump circulation capacity was 1000 liters of slurry per hour. The temperature of the slurry was kept constant at about 40° C. during milling. The finished milled slurry was cooled to 30.6° C. and mixed to a homogeneous consistency with 24 kg of a paraffin emulsion (48.8% water, by weight; 48.8% paraffin, by weight; the remainder an emulsifier). Water was then added to achieve a solid particle concentration of 75% by weight and a viscosity of 3000 mPa·s. The emulsion was produced in a standard commercially available emulsifying unit manufactured by the company IKA, Germany. In the process, 2 kg of a standard emulsifier consisting primarily of a mixture of fatty alcohol polyglycol ether and monodiglyceride was added to 40 kg of paraffin and melted down at 85° C. (The exact composition of the emulsifier must be empirically matched to suit the composition of the paraffin used.) Following melting, 40 kg of water were added and heated to the same temperature. Then the high-dispersion emulsification unit was turned on for 60 minutes to produce the emulsion. Afterwards, the emulsion was cooled at a controlled rate of 2° C. per minute to room temperature with the aid of an agitator. A test of droplet-size distribution conducted in a laser granulometer showed a mean diameter ($d_{50}$) of 1.16 $\mu$m.

Figure 2:
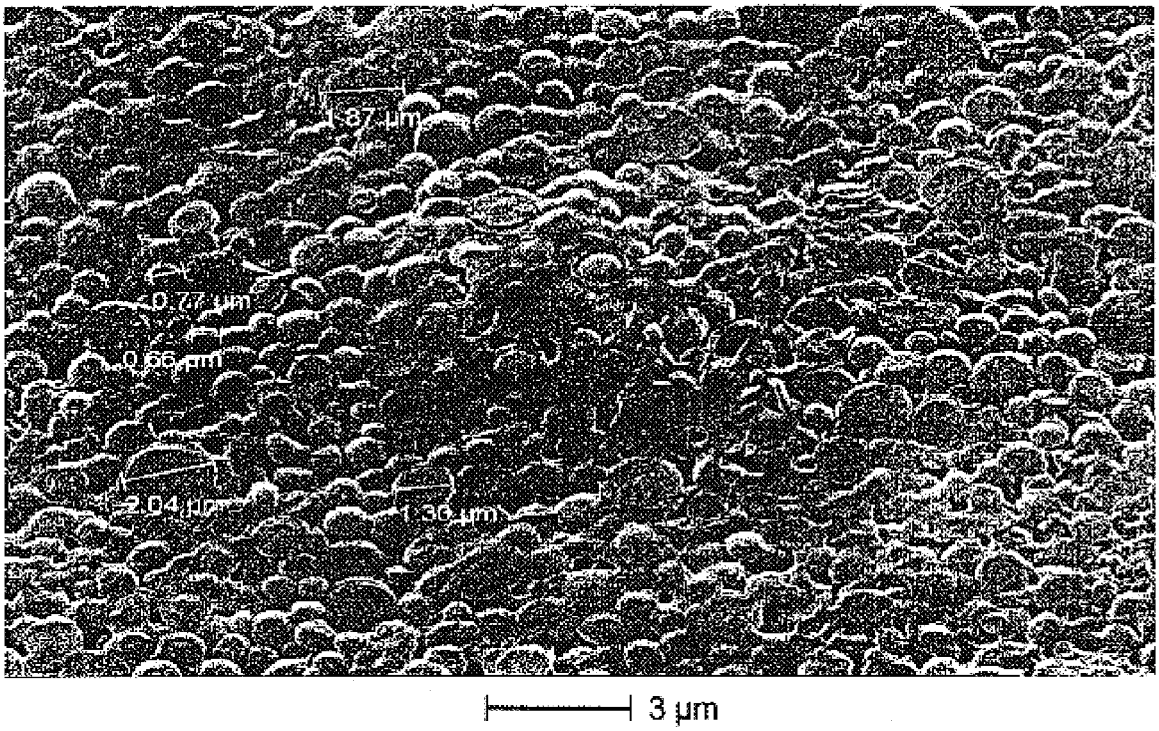
FIG. 2 is a KRYO-SEM exposure of the finished emulsion in a 7,500× enlargement.

FIG. 2 shows a KRYO-SEM exposure of the finished emulsion in a 7,500-power enlargement. The micrograph (ID 00022442) was taken at the REM laboratory of the University of Basle, Switzerland.

For granulation of the slurry produced in this way, a spray tower 1 with a cylindrical segment 2 measuring 6 m in height and 4 m in diameter and a downward pointing, conical segment 3 with a cone angle of 50° was used. Tower volume was 93 $m^3$. The spray tower was designed for countercurrent operation on the basis of the fountain principle. Air was used to dry the slurry and was introduced into the spray tower at a rate of 4000 $m^3$/h.

The slurry was sprayed into the spray tower through a spray lance 4 with a single-component nozzle 5 with an outlet opening measuring 1.12 mm in diameter at a pressure of 15 bar, which resulted in a slurry concentration of 0.08 kg slurry per $m^3$ of drying air. The air exit temperature was set at a constant value of 88° C., which was achieved under the prevailing conditions by introducing drying air at a temperature of 145° C. At an air inflow rate of 4,000 $m^3$ per hour, the atomization of 0.08 kg of slurry per $m^3$ of drying air resulted in a spray rate of 320 kg of slurry per hour. Since the solid particle concentration of the slurry was set at 75% by weight, the spray output of 320 kg per hour equates to an hourly input of 80 liters of water.

Thus ratio of water input per hour to tower volume was $$\frac{80\ \text{l/h}}{93\ \text{m}^3} = \frac{0.86\ \text{l}}{\text{m}^3 \cdot \text{h}}$$

The oxygen concentration in the granulate produced was 0.51% by weight.

Figure 3:
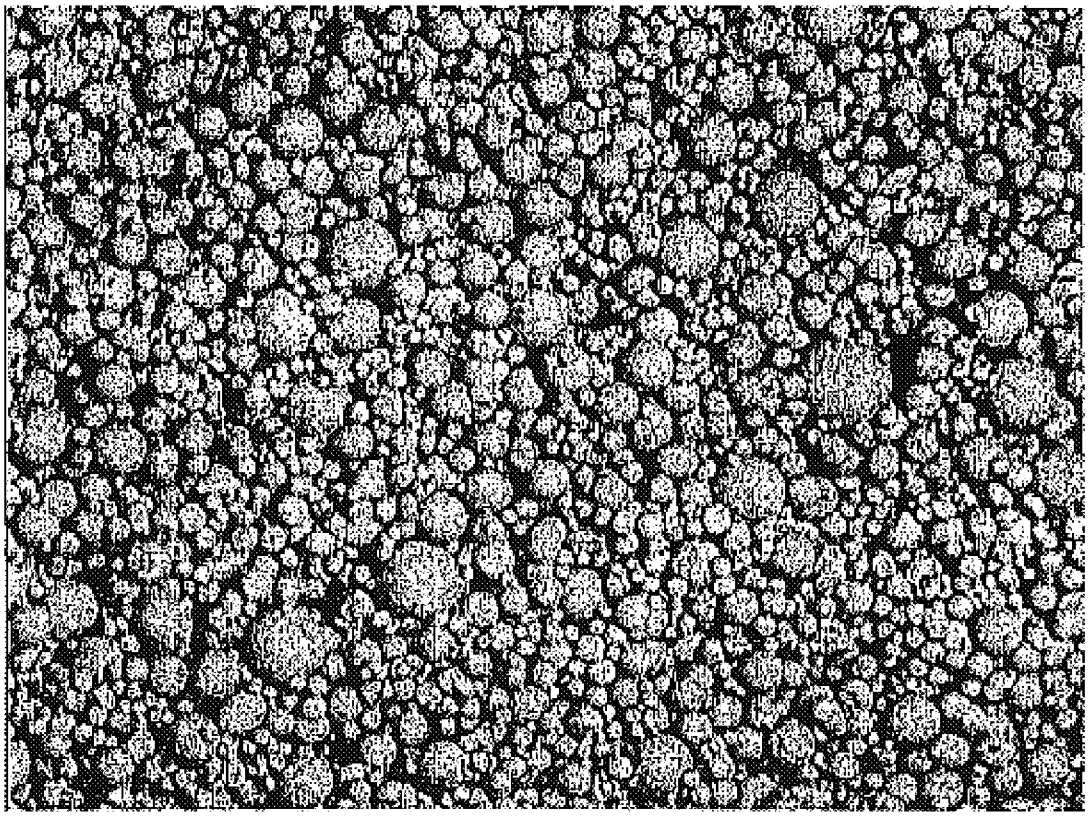
FIG. 3 shows an image (50× enlargement) of a hard metal granulate with a mean particle size of 125 μm produced in accordance with the above example.

FIG. 3 shows an image (50-× enlargement) of a hard metal granulate with a mean particle size of 125 $\mu$m. The granulate was produced in accordance with the above example.

We claim:

1. A method of producing a refractory hard metal grade powder of hard material, metal binder, and non-water-soluble pressing aid components, the method which comprises:

milling the hard material and the metal binder with water as a liquid phase to prepare a slurry;

subsequently mixing the pressing aid components in the form of an emulsion produced with an emulsifier and an addition of water with the slurry; and drying the slurry with the hard material, the metal binder, and the pressing aid components to form a hard metal grade powder.

2. The method of producing a hard metal grade powder according to claim 1, which comprises using an emulsifier suitable for producing an emulsion with a mean droplet diameter of less than 1.5 $\mu$m.

3. The method of producing a hard metal grade powder according to claim 1, which comprises employing paraffin as a pressing aid.

4. The method of producing a hard metal grade powder according to claim 3, which comprises employing an emulsifier consisting of a mixture of fatty alcohol polyglycol ether and monodiglycerides.

5. The method of producing a hard metal grade powder according to claim 1, wherein the milling step comprises milling in an attritor, the slurry having a viscosity ranging from 2,500 to 8,000 mPa·s, with a four-fold to an eight-fold volume exchange per hour.

6. The method according to claim 1, wherein the drying step comprises spray drying the slurry in a spray drying system to form a hard metal granulate.

7. The method according to claim 6, which comprises spray drying the slurry in a spray drying system having a spray tower formed with a cylindrical segment and a conical segment, injecting drying gas into the system at a temperature of 130°–195° C. and removing the gas from the system at a temperature ranging between 85° and 117° C., and thereby operating the spray tower such that a ratio of the water added via the slurry, in liters per hour, to tower volume, in $m^3$, is between 0.5 and 1.8, and a maximum of 0.17 kg of slurry is atomized per $m^3$ of incoming drying gas, and wherein the slurry has a solid particle concentration in a range of 65–85% by weight.

8. The method according to claim 7, which comprises spray drying the slurry in a counter-current process based on a fountain principle, and employing air as the drying gas.

9. The method according to claim 8, which comprises adjusting a gas entry temperature and a gas exit temperature to set a temperature between about 70° and 120° C. at a geometric midpoint S of the spray tower.

10. A sintered hard metal alloy, comprising a hard metal grade powder produced by the method according to claim 1.

11. A method of producing a hard metal alloy, which comprises: forming a hard metal grade powder with the method according to claim 1, and sintering the powder together with further components to form a sintered hard metal alloy.

* * * * *